US009415522B2

(12) United States Patent
Oglesby et al.

(10) Patent No.: US 9,415,522 B2
(45) Date of Patent: Aug. 16, 2016

(54) RAZOR CARTRIDGE WITH SKIN CONTACT ELEMENT

(75) Inventors: Oliver David Oglesby, Newbury (GB); Mark Peterson, Reading (GB)

(73) Assignee: The Gillette Company, Boston, MA (US)

( * ) Notice: Subject to any disclaimer, the term of this patent is extended or adjusted under 35 U.S.C. 154(b) by 278 days.

(21) Appl. No.: 13/524,650

(22) Filed: Jun. 15, 2012

(65) Prior Publication Data

US 2012/0317818 A1 Dec. 20, 2012

(30) Foreign Application Priority Data

Jun. 20, 2011 (EP) ..... 11170574

(51) Int. Cl.
*B26B 21/22* (2006.01)
*B26B 21/40* (2006.01)

(52) U.S. Cl.
CPC ..... *B26B 21/4018* (2013.01); *B26B 21/4031* (2013.01)

(58) Field of Classification Search
CPC ..... B26B 21/22; B26B 21/42
USPC ..... 30/34.05, 34.2, 50, 77
See application file for complete search history.

(56) References Cited

U.S. PATENT DOCUMENTS 5,369,885 A 12/1994 Ferraro
5,802,721 A 9/1998 Wain et al.
6,161,288 A * 12/2000 Andrews ..... 30/50
6,243,951 B1 6/2001 Oldroyd
6,434,828 B1 * 8/2002 Andrews ..... 30/50
7,617,607 B2 11/2009 Pennell et al.
7,681,314 B2 * 3/2010 Follo ..... 30/34.2
8,209,867 B2 7/2012 Clarke
8,429,826 B2 * 4/2013 Clarke ..... 30/34.2
8,782,903 B2 * 7/2014 Clarke et al. ..... 30/34.1

(Continued)

FOREIGN PATENT DOCUMENTS

WO WO 94/11163 A1 5/1994
WO WO 95/29043 A1 11/1995

(Continued)

OTHER PUBLICATIONS

U.S. Appl. No. 13/524,717, filed Jun. 15, 2012, Daren Mark Howell, Andrew Martin Whittingham.

*Primary Examiner* — Hwei C Payer
(74) *Attorney, Agent, or Firm* — Joanne N. Pappas; Kevin C. Johnson; Steven W. Miller

(57) ABSTRACT

A razor cartridge comprising a housing; a guard located at the front of the housing; a cap located at the rear of the housing; two or more blades disposed in the housing between the guard and the cap; a skin contact element extending across the housing between two of said blades; and a plurality of projections extending from a base of said skin contact element, each having a skin contacting surface, the projections being spaced along the length of the skin contact element, wherein there is a pitch of up to 2 mm between adjacent projections and the skin contacting surface has a width extending for up to 35% of the pitch.

11 Claims, 18 Drawing Sheets

(56) References Cited

U.S. PATENT DOCUMENTS

| | | | | |
|---|---|---|---|---|
| 2004/0231161 | A1 | 11/2004 | Coffin et al. | |
| 2005/0198837 | A1 | 9/2005 | Rawle | |
| 2010/0083510 | A1* | 4/2010 | Clarke | 30/346.5 |
| 2011/0146079 | A1 | 6/2011 | Clarke et al. | |
| 2012/0110857 | A1 | 5/2012 | Peterson et al. | |
| 2012/0317818 | A1* | 12/2012 | Oglesby et al. | 30/77 |
| 2012/0324737 | A1* | 12/2012 | Howell et al. | 30/50 |

FOREIGN PATENT DOCUMENTS

| | | | |
|---|---|---|---|
| WO | WO 2011/075505 | A1 | 6/2011 |
| WO | WO 2012/061343 | A1 | 5/2012 |
| WO | WO 2012/177677 | A1 * | 12/2012 |

* cited by examiner

RAZOR CARTRIDGE WITH SKIN CONTACT ELEMENT

FIELD OF THE INVENTION

This invention relates to shaving razors and more particularly to shaving razor cartridges having a skin contact element disposed between two blades.

BACKGROUND OF THE INVENTION

Many razors for wet shaving on the market today have one or more razor blades (with many having three to six razor blades) within a razor cartridge which is operatively coupled to a handle, some razors being disposable and some razors having a reusable handle. Razor cartridges having multiple blades are described, for instance, in US Patent Publication No. 2005/0039337A1 published on Feb. 24, 2005, and one such razor cartridge has been commercialized as the five bladed Fusion™ Razor by The Gillette Company.

While multiple blades provide an improved close shave, generally some performance issues may still arise. Firstly, some discomfort may be realized by users during shaving. Secondly, shaving is still a relatively slow and inefficient process due to missed hairs and the difficulty in shaving problem areas such as the neck. Many shavers discern a substantial amount of missed hairs (e.g., hairs which are not cut at all or hairs that are not cut close to the skin or at the skin line) despite the bulk of hairs being cut.

In addition, it has been shown that some areas (e.g., neck, chin, and/or face) are particularly hard to shave. These areas generally have low-lying hairs that are often oriented in different directions. These low-lying hairs may be close, flat, or flush against the skin. In many instances, the user has to shave the same area repeatedly in attempting to cut hair that was either uncut or not cut close enough to the skin, resulting in increased skin irritation.

The discomfort aspect may be due to the increased number and sharpness of the blades and the cumulative force or loading on the skin, particularly in cartridges with three or more sharp blade edges.

Some prior art solutions which attempt to lessen the discomfort while maintaining safety and closeness provide, among other attributes, a reduced span of the blades from tip to tip, often referred to as the blade tip span. While such a reduction is generally known to provide better skin management by reducing the skin bulge between blades, it is also known to reduce the rinse-ability of hair clippings, skin particles, shaving cream, and/or other debris between the blades as the narrower spans decrease the size of the rinse-through gaps between the blades.

An alternative prior art solution to reducing discomfort by reducing blade load has been to increase the number of blades. Prior art applications introduce additional blades or elements attached to the blades. However, these interact with hair such that hair is displaced from an optimal cutting position when the blades engage with hair. No consideration is given as to how to reduce blade load and manage skin bulge whilst minimising any interaction with hair. Solid inter-blade elements or inter-blade elements which comprise a large skin contact area, such as those disclosed in the art, can lead to hair becoming trapped and consequently to less efficient cutting and greater irritation. Thus, there is still a need to improve skin management without hair interaction.

SUMMARY OF THE INVENTION

The invention provides a razor cartridge comprising a housing; a guard located at the front of the housing; a cap located at the rear of the housing; two or more blades disposed in the housing between the guard and the cap; a skin contact element extending across the housing between two of said blades; and a plurality of projections extending from a base of said skin contact element, each having a skin contacting surface, the projections being spaced along the length of the skin contact element, wherein there is a pitch of up to 2 mm between adjacent projections and the skin contacting surface has a width (w) extending for up to 35% of the pitch.

The frequency of projections across the skin contacting element provides contact points with the surface being shaved. As the skin contact surface extends for up to 35% of the pitch, sufficient support and control is provided to the skin surface while still allowing sufficient room for hair to pass through the skin contact element. As such, the present invention allows the reduction of load on a razor cartridge without the addition of any extra blades, whilst minimising with the impact on hair being shaved.

BRIEF DESCRIPTION OF THE DRAWINGS

While the specification concludes with claims particularly pointing out and distinctly claiming the subject matter which is regarded as forming the present invention, it is believed that the invention will be better understood from the following description which is taken in conjunction with the accompanying drawings in which like designations are used to designate substantially identical elements, and in which:

DETAILED DESCRIPTION OF THE INVENTION

This invention relates to a razor cartridge in a razor for wet shaving having a skin contact element disposed between two blades within a blade array. The term "skin contact element" as used herein, signifies a physical structure which generally does not cut hair or skin but contacts, engages, controls, enhances, agitates or stretches a user's skin providing skin management (e.g., reduction of skin bulge) during shaving and which comprises a plurality of projections. A "blade array" as used herein is defined as an array of one or more razor blades (e.g., generally multiple blades), each blade having a cutting edge where each cutting edge is generally facing in the same direction. Blade cutting edge or blade edge may be used interchangeably with blade tip herein, where a blade tip may represent a point on a blade edge. The razor cartridge may be considered as having a "mixed blade array" with mixed functionality in that there are cutting and skin contact elements in the array.

Figure 1:
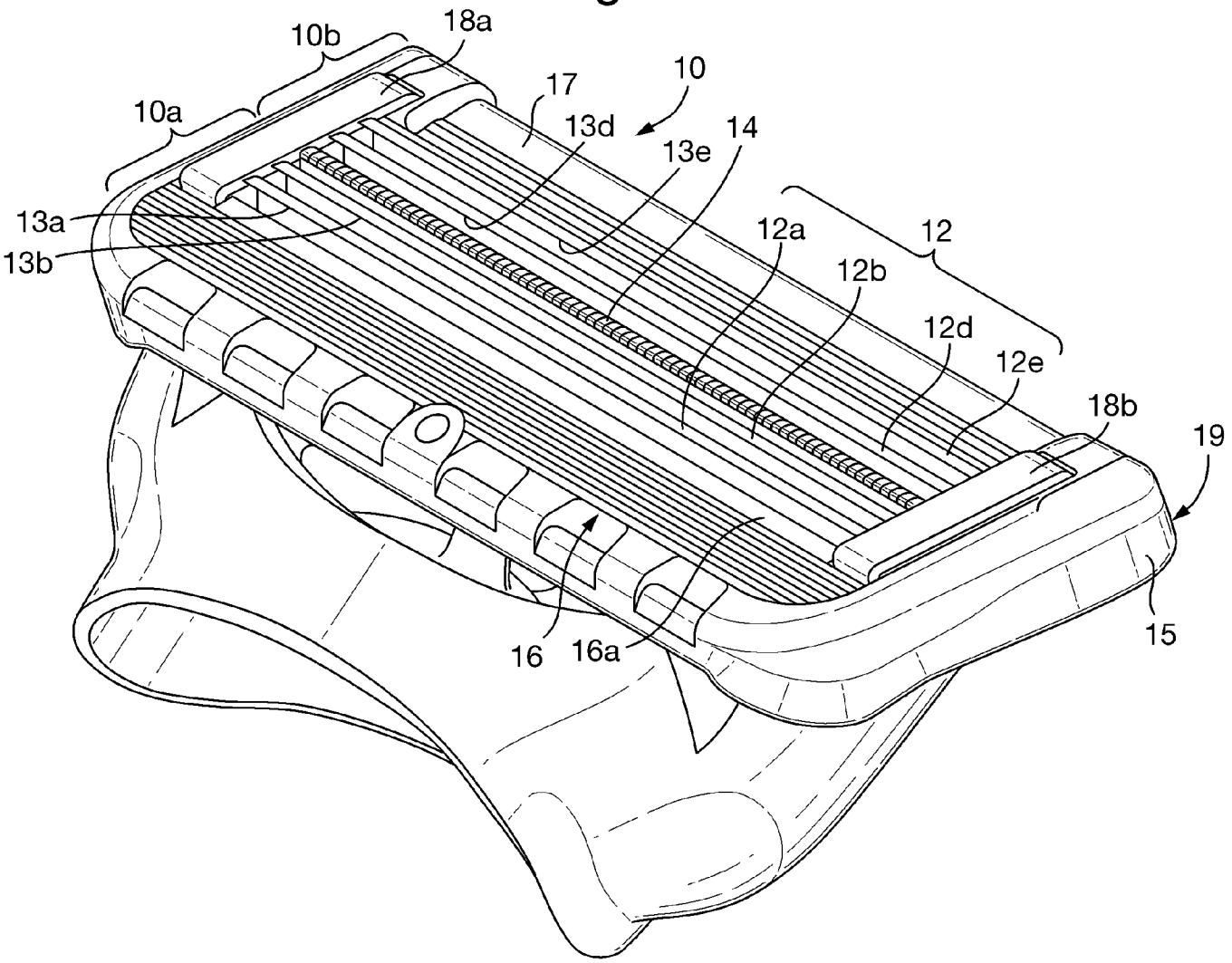
FIG. 1 is a perspective view of a razor cartridge showing a skin contact element therein in accordance with the present invention.

FIG. 1 shows a razor cartridge 10 having a blade array 12 comprising four blades, 12*a*, 12*b*, 12*d*, and 12*e*, each having respective cutting edges 13*a*, 13*b*, 13*d*, 13*e*, and a skin contact element 14 disposed in between two of the blades 12*b* and 12*d*. Thus, the razor cartridge may be considered as having a "mixed blade array" with mixed functionality in that there are cutting and skin contact elements in the array.

It should be noted that, generally, the guard 16 (and/or guard bar 16*a*) of a razor cartridge 10 disposed at the front of the cartridge is known to produce higher friction at the front of the cartridge stretching the skin ahead of the blades and desirably supporting or aligning hairs during the shaving process, while the cap 17 is generally known to be a low friction element located at the back of the cartridge allowing the skin to glide past the back of the cartridge while assisting in maintaining skin stretch. The cap may desirably also provide lubrication, smooth glide or other skin control.

Although four blades are shown in FIG. 1, it is understood that any number of blades, more or less, may be mounted within the cartridge 10. The housing 19 of conventional razors generally includes the frame 15 and the guard 16 and/or guard bar 16*a*. The blades 12*a*, 12*b*, 12*d*, and 12*e* and the skin contact element 14 are shown secured within the housing 19 with the clips 18*a* and 18*b*. The skin contact element 14 may be secured, mounted or otherwise coupled within the frame 15 of the housing 19 via mechanical (e.g., spring loaded, compression fit), thermal, chemical means, or other means known to those of skill in the art, but desirably in the same manner as conventional blades. Other assembly methods for the skin contact element of the present invention will also be described in more detail below.

The skin contact element 14 may advantageously be installed just as a regular or standard blade (e.g., blade with blade support or bent blade) or it may be installed having spring-loaded capabilities.

Figure 2:
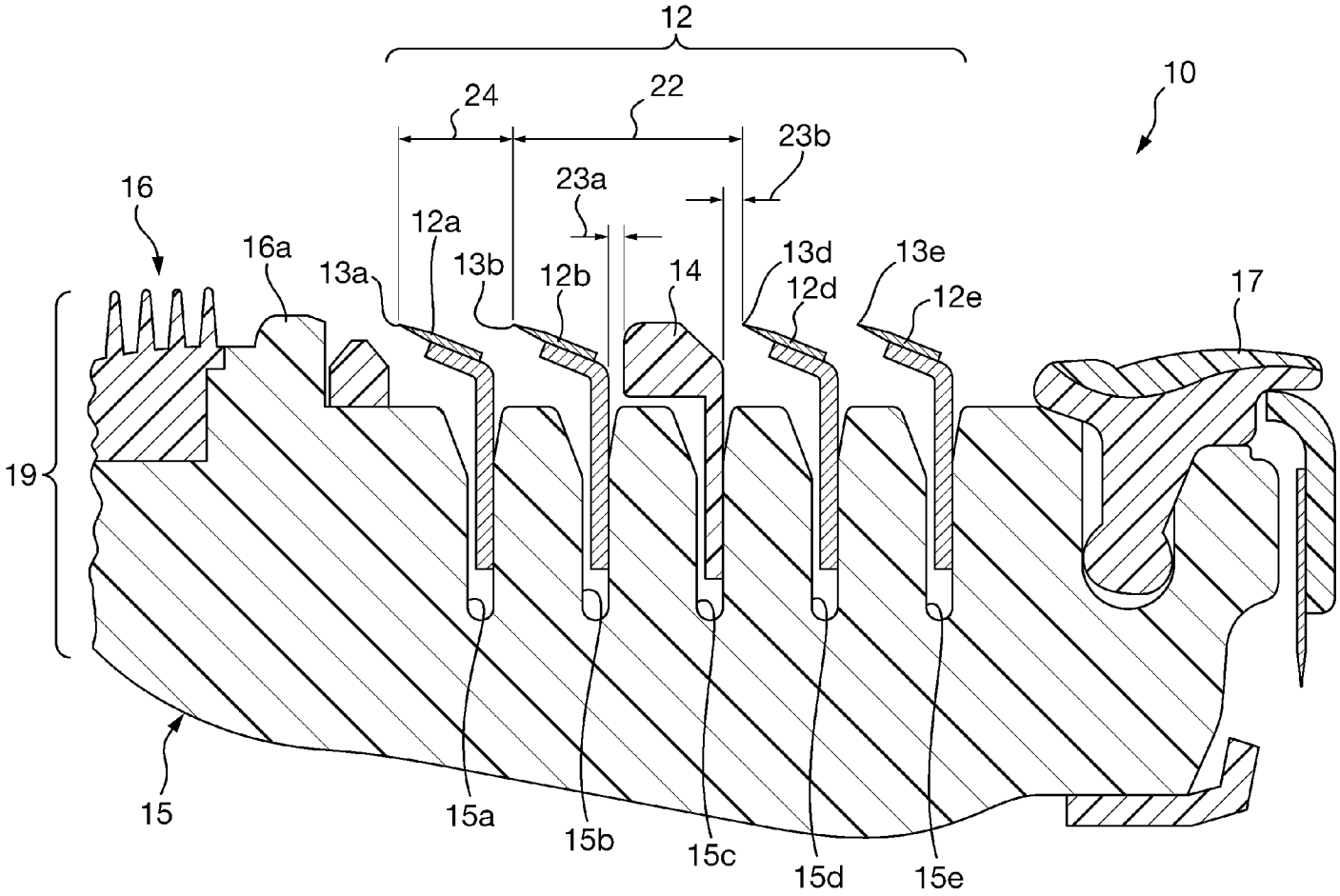
FIG. 2 is a cross-sectional view of the razor cartridge of FIG. 1.

FIG. 1 shows skin contact element 14 positioned midway through blade array 12 near or in the standard $3^{rd}$ blade position (or blade slot 15*c* as shown in FIG. 2) when viewed traveling in the width-wise direction of the cartridge 10 from the guard 16 toward the cap 17. In one embodiment, the skin contact element takes the place of one of the blades and in effect, splits the cartridge into two units, cartridge unit 10*a* and cartridge unit 10*b*, a cartridge unit in front of the skin contact element 14 and a cartridge unit behind skin contact element 14, respectively. The skin contact element 14 may be encompassed in both cartridge units 10*a* and 10*b* or in general, may be disposed anywhere between the cap 17 and the guard 16 in the cartridge 10. Furthermore, the skin contact element may be provided in addition to a standard blade array.

Figure 1A:
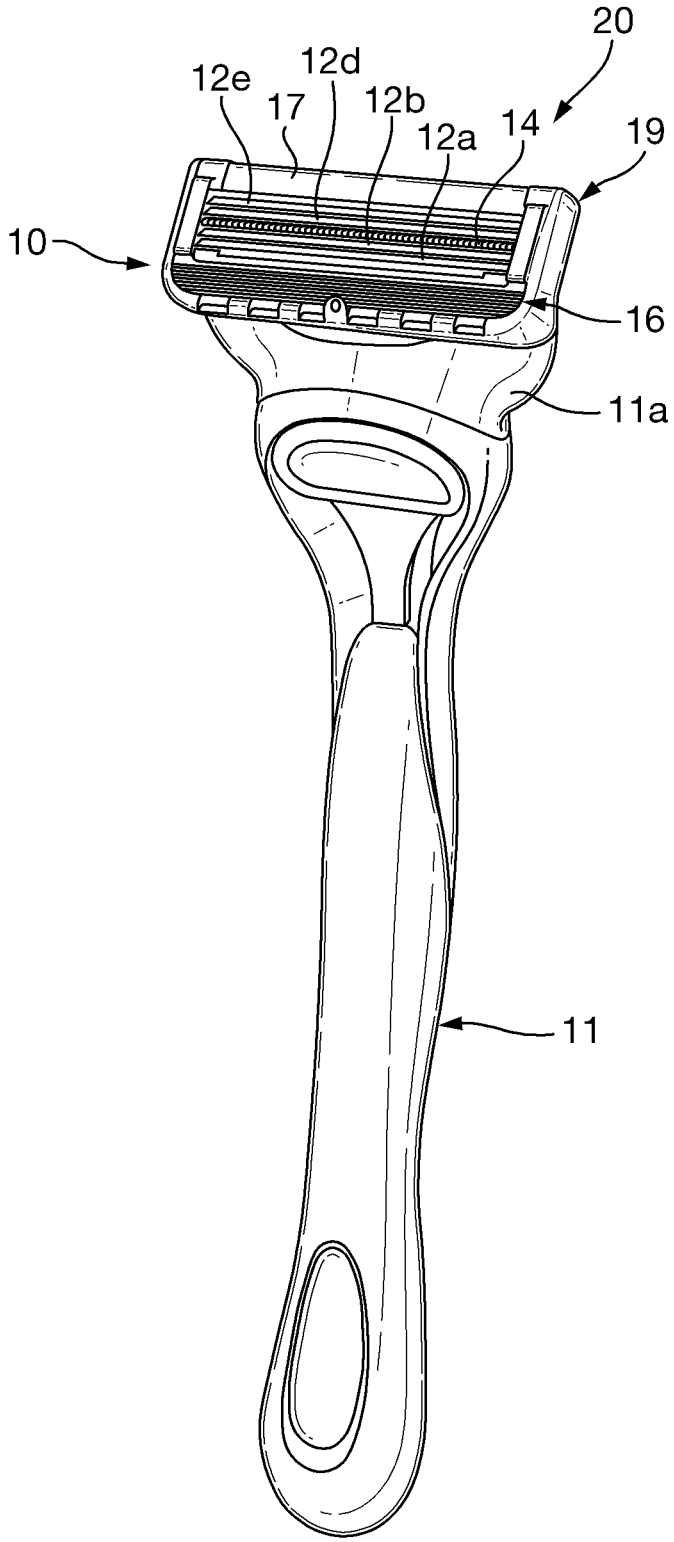
FIG. 1A is a perspective view of the razor cartridge of FIG. 1 shown attached to a handle.

FIG. 1A depicts the razor cartridge 10 of FIG. 1 operatively coupled to a handle 11 via interconnect member 11*a* to provide a functional razor 20. In the present invention, the razor may be entirely disposable or the razor may include a reusable handle with a disposable cartridge.

Referring now to FIG. 2, a cross-sectional side view of FIG. 1 is depicted where it can be seen that the skin contact element may be disposed within slot 15*c* and may be centrally located in a blade array 12 (e.g., or a "mixed" blade array 12). In embodiments, the skin contact element 14 is a standalone or independent element and is not attached to another blade. However, it will be appreciated that the skin contact element may be attached to a blade or blade support or may form an extension of a blade or blade support.

Figure 3A:
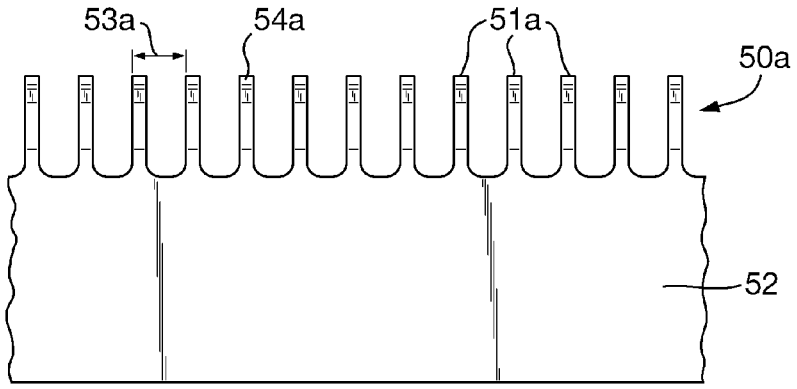
FIGS. 3A through 3F are perspective views of possible embodiments of skin contact elements in accordance with the present invention.
Figure 3B:
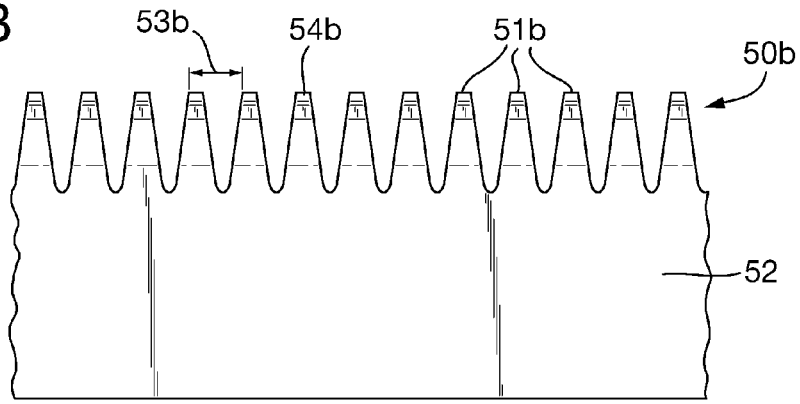
Figure 3C:
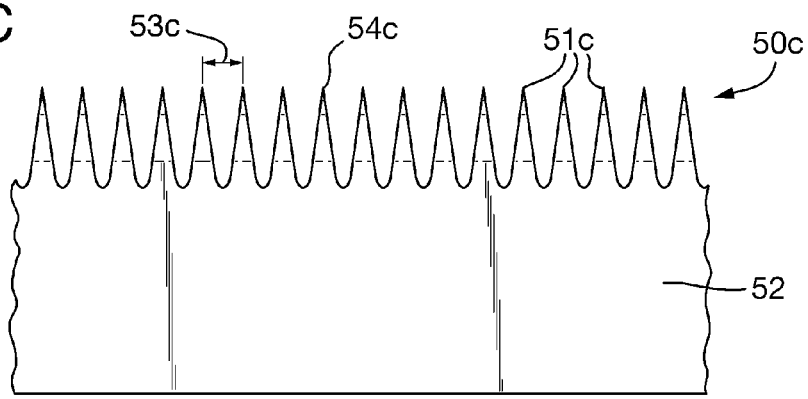

Referring now to FIGS. 3A to 3C, various designs of skin contact elements 50 within the scope of the present invention are shown.

In FIGS. 3A to 3C, the skin contact element 50*a*, 50*b*, 50*c*, comprises a plurality of projections 51*a*, 51*b*, 51*c* extending from a base 52. The present invention contemplates a number of forms of projection 51*a*, 51*b*, 51*c* which may each be similar in construction.

As can be seen in FIG. 1, the skin contact element extends generally across the length of the cartridge. Cartridges currently available on the market have lengths of between 30 mm and 40 mm. The skin contact element(s) of the present invention may generally extend for about the same length as the blades.

The pitch between adjacent projections is measured from corresponding points on each projection in a lengthwise direction along the cartridge. The projections have a pitch 53*a*, 53*b*, 53*c*, of up to 2 mm extending across the length of the skin contact element, preferably up to 1.75 mm and even more preferably up to 1.5 mm. The skin contacting surface 54*a*, 54*b*, 54*c* may be about 0.10 mm to about 0.70 mm in width and desirably about 0.2 mm to about 0.3 mm, such that the skin contacting surface extends for up to 35% of the pitch, preferably up to 25% of the pitch and even more preferably up to 15% of the pitch.

The skin contacting surface provides a contact point with the skin, allowing the skin to be controlled. As the skin contact surface extends for up to 35% of the pitch, sufficient support and control is provided to the skin surface while still allowing sufficient room for hair to pass through the skin contact element. As such, the present invention allows the reduction of load on a razor cartridge without the addition of any extra blades, whilst minimising with the impact on hair being shaved.

Figure 3D:
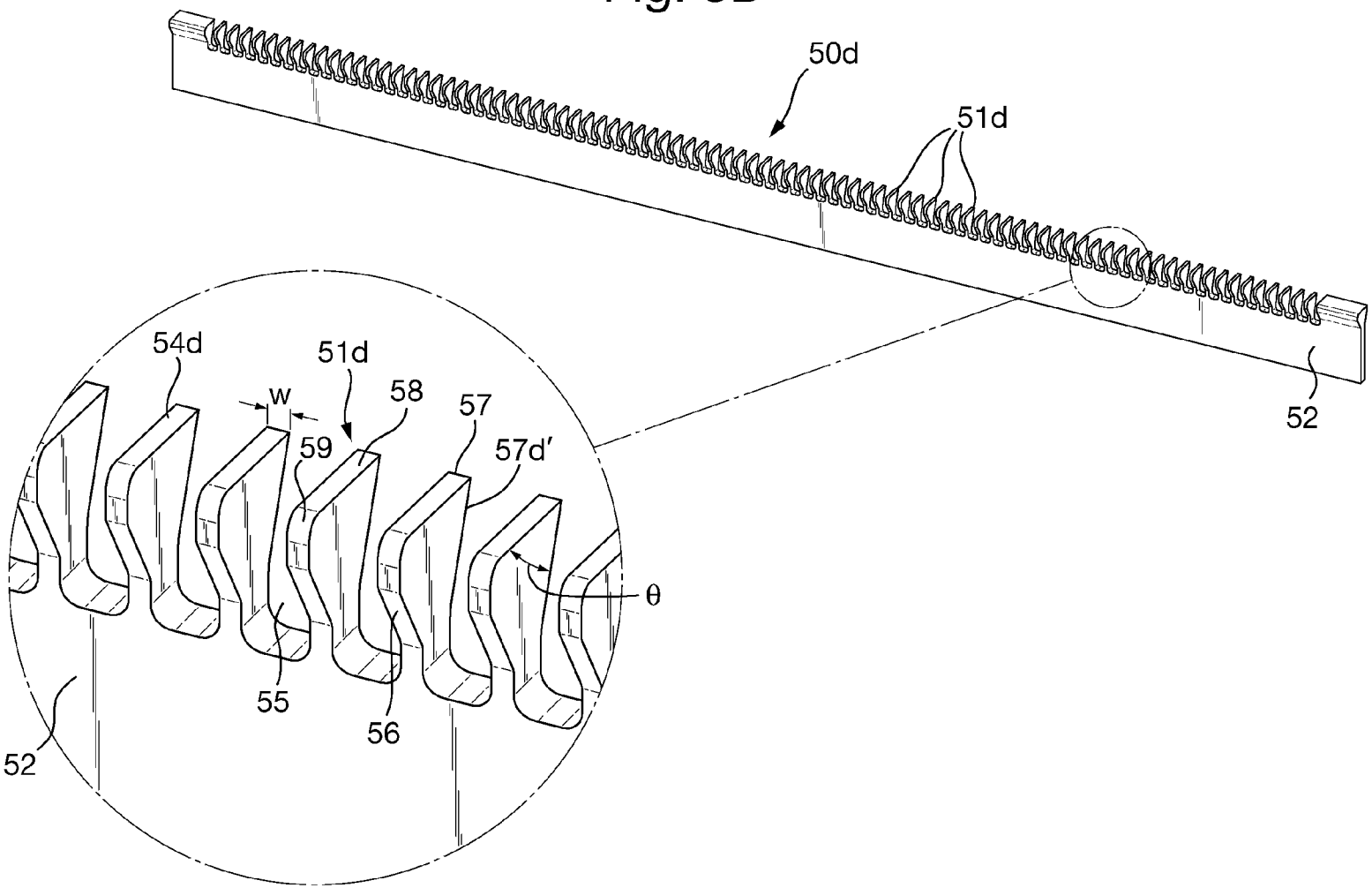
Figure 3E:
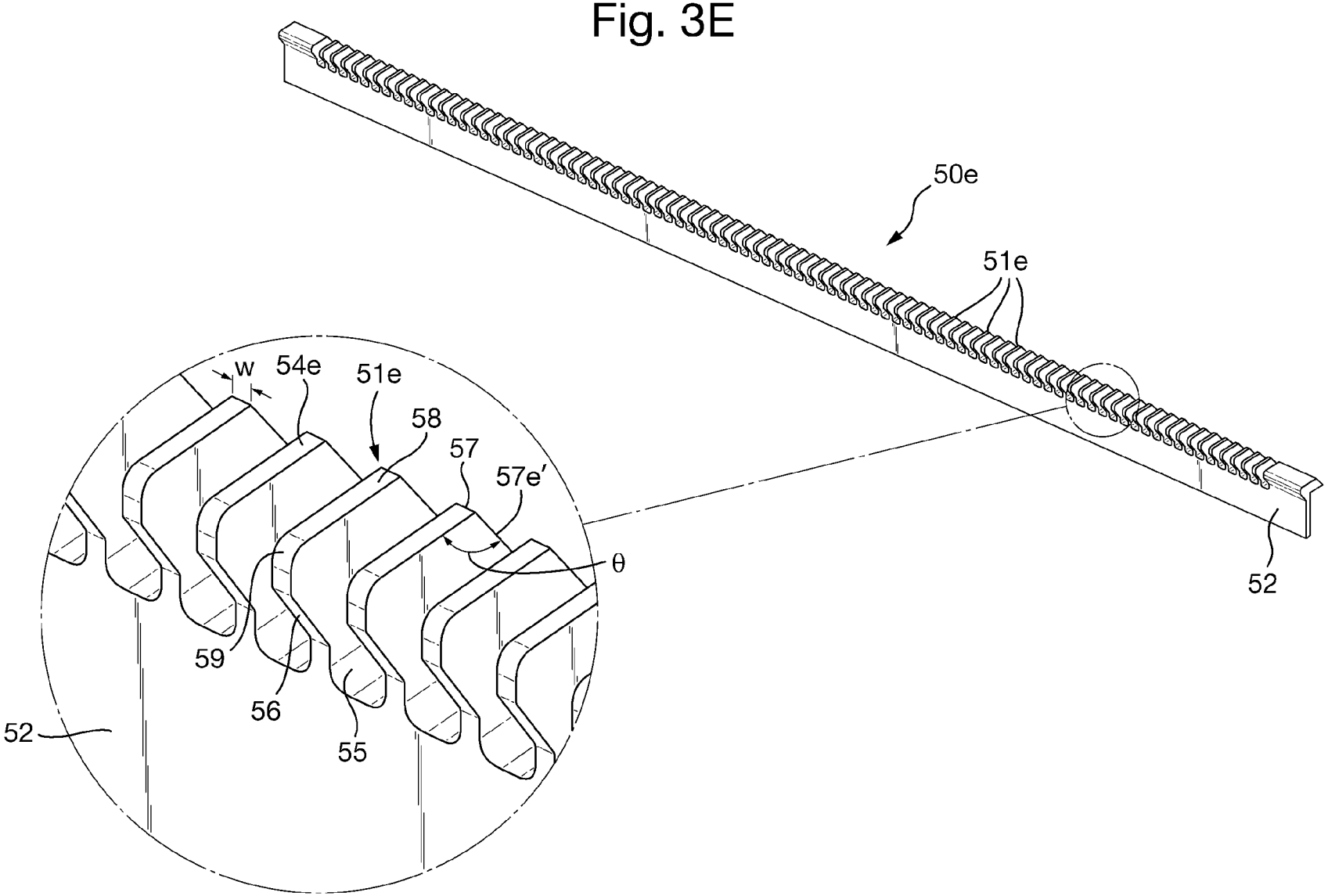
Figure 3F:
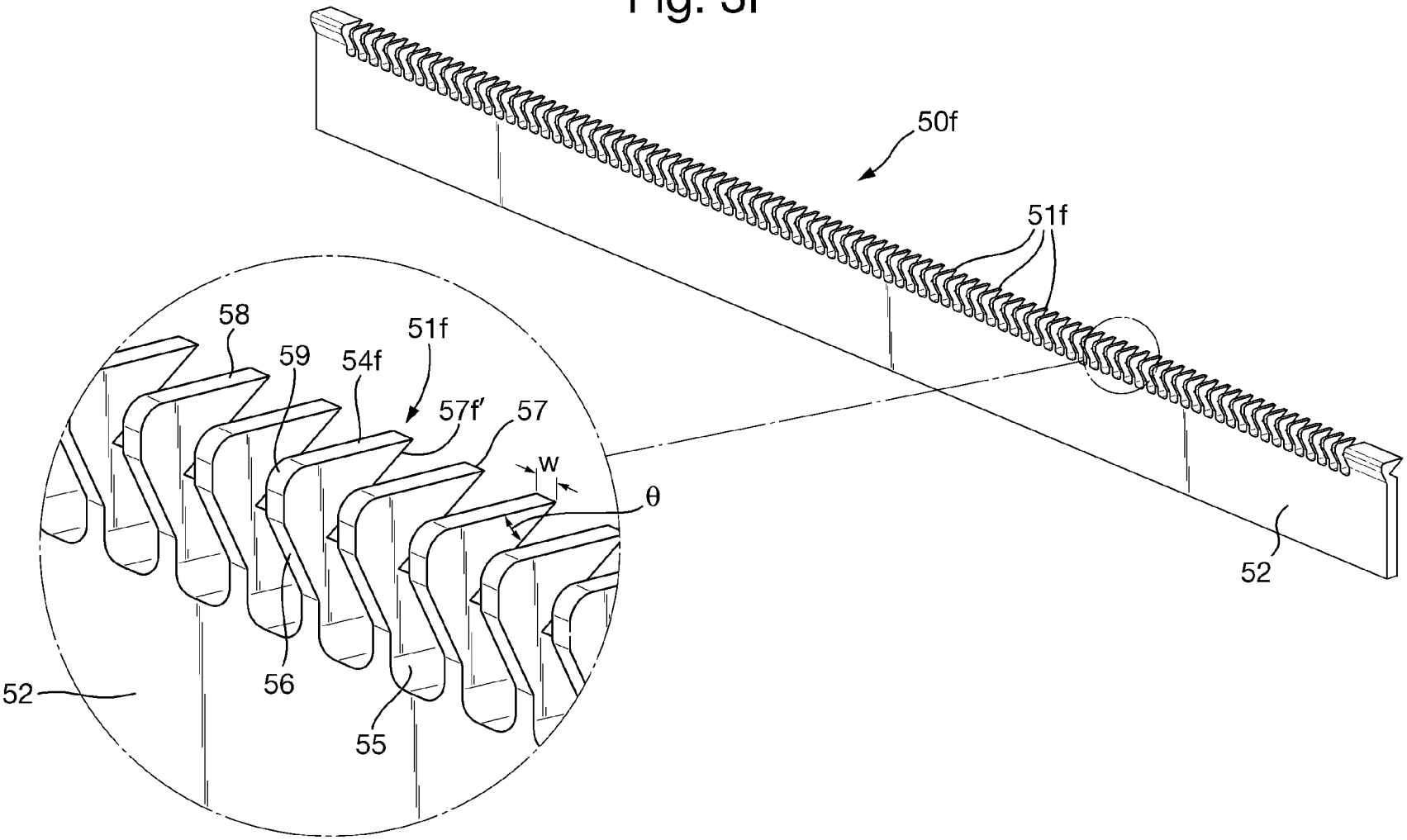

Referring to the close-up view in FIGS. 3D-F, a detailed perspective view of two adjacent projections 51*d*, 51*e*, 51*f*, is shown. A slot 55 may be defined between the adjacent projections 51*d*, 51*e*, 51*f* having a width that allows free passage of hair. The skin contact element provides a sufficient skin contact area to support the skin during shaving. Preferably, the plurality of projections result in a plurality of slots with a width of from 0.19 mm to 1.3 mm, preferably about 0.3 mm, for allowing the free passage of hair during shaving.

The pair of adjacent projections 51*d*, 51*e*, 51*f*, as mentioned define the slot 55 that is configured to allow hairs through with little or no interaction with the hair so the hair is not captured, trapped or pulled by projections 51*d*, 51*e*, 51*f*, which may cause discomfort. The slots 55 are spaced so as to not impede the hair. The projections 51*d*, 51*e*, 51*f*, are also configured to reduce skin bulges within the slots 55 and pressure points at ends of slots 55 which may result if the projections 51*d*, 51*e*, 51*f* are spaced too far apart. Skin bulges may lead to the blade edges (e.g., in particular blade 12*d*, not shown) unnecessarily cutting the skin, resulting in discomfort. The relatively large number of projections 51*d*, 51*e*, 51*f*, over the length of the skin contact element 50*d*, 50*e*, 50*f*, serves to distribute the force placed on the skin by the cartridge 10. As the size of the slots 55 may also increase the number of hairs passing through the slots 55 of the skin contact element, this may increase the number hairs that are properly cut by the blade edge 13*d* of blade 12*d* (not shown) for instance, if arranged as in FIG. 1 for instance of the present invention.

Each projection comprises a front face 56, a rear face 57 and a top face 58. The top face forms at least part of the skin contacting surface 54*d*, 54*e*, 54*f*, however in embodiments this also extends onto the front face of the projection 51*d*, 51*e*, 51*f*. Each projection has a height measured from a base 52, to the top face 58, of the projection 51*d*, 51*e*, 51*f*. Each projection has a depth as measured from the front face 56 of the projection to the rear face 57 of the projection. The top face and the front face of the projections 51*d*, 51*e*, 51*f* may be joined by a curved section 59 which may form part of the skin contacting surface 54*d*, 54*e*, 54*f*. The projections 51*d*, 51*e*, 51*f* may comprise a substantially flat portion on the top surface. Each projection has a rear edge 57*d*', 57*e*', 57*f*'.

The skin contacting surface 54*d*, 54*e*, 54*f* may have a width w of about 0.10 mm to about 0.70 mm and preferably about 0.2 mm to about 0.3 mm. The height as measured from the base 52, to the top face 58, of the projection 51*d*, 51*e*, 51*f* may be of about 0.25 mm to about 1 mm and preferably about 0.50 mm. Each projection generally has a depth of between about 0.3 mm to about 2.5 mm and preferably about 0.8 mm as measured from a front face of the projection 53 to a rear face of the projection 54.

The projections 51*a*, 51*b*, 51*c* may comprise a curved section 59 of up to 0.3 mm in length which joins the front face and the top face. The projections 51*d*, 51*e*, 51*f* may comprise a substantially flat portion on the top face of up to 0.6 mm in length. The rear edge 57' of the projection 51*d*, 51*e*, 51*f*, may be at an angle θ of from +45° to −60° as measured from the top face to the base. Preferably the angle θ is from +10° to −30°.

The skin contact element of the present invention may be made of any type of material such as, but not limited to, polymeric, elastomeric, thermoplastic elastomers, urethanes, olefins, rubbers, metals, or any combination thereof. Elastomers such as silicone, fluorosilicone, polyisoprene, polybutadiene, polyisobutylene, copolymers such as styrene-ethylene-butylene-styrene (SEBS) based thermoplastic elastomer, styrene-ethylene-propylene-styrene (SEPS) based thermoplastic elastomer, polyoxyethylene-polyurethane based elastomer, or other polymers such as polyurethane, polystyrene and polyethylene, or rubbers such as acrylonitrile-butadiene, polyacrylate and natural rubber, or any combination thereof are also contemplated in the present invention. Additionally, the skin contact element material may include modifications of one or more of the above-listed materials (e.g., polymers and rubbers and their composites) with other materials.

If made of a polymeric or other elastomeric material, the skin contact element may be injection-molded. If made of metal, such as aluminium or stainless steel, the skin contact element may be machined or tooled.

Furthermore, the materials for a skin contact element may include textile or fabric materials, natural materials (e.g., wood), or metals coated or integrated with elastomeric or plastic materials.

The skin contact element may include materials with lubricant, shaving aid, or exfoliation capabilities. The term "shaving aid material" as used herein signifies any composition for use with skin and/or hair. Such compositions may include, but are not limited to, lubricious agents such as hydrophilic polymers (e.g., polyethylene oxide/polystyrene or PEO/PS), or agents for depilation, cleaning, cooling, inhibiting or enhancing the growth of hair, inhibiting the growth of microbes, inhibiting drag, inhibiting wrinkles, moisturizing, improving skin tone or condition, medicinal purposes, or any combination thereof. Agents may include, but are not limited to, ingredients such as aloe, vitamin E, lanolin, perfumes, or glycolic acids.

One factor which affects how a blade is presented to the skin is the exposure or the amount a blade is pressed into or lifted away from the skin impacting the blade loading on the skin. Another factor which affects how a blade is presented to the skin is the span between elements (e.g., such as between blades), which impacts the skin bulge ahead of the blade, and also impacts the blade loading on the skin. It is also known in the shaving arts that, in addition to exposures and spans, the management of skin and hair may also be affected by many additional inter-related variables such as the number of blades in a razor cartridge, the types of blades, and the angles of the blades relative to the skin line. The skin contact element of the present invention has the ability to provide additional control of these inter-related variables in the blade array impacting skin management. For instance, the skin contact element provides an improved control point for the blade loading on the skin.

Figure 4A:
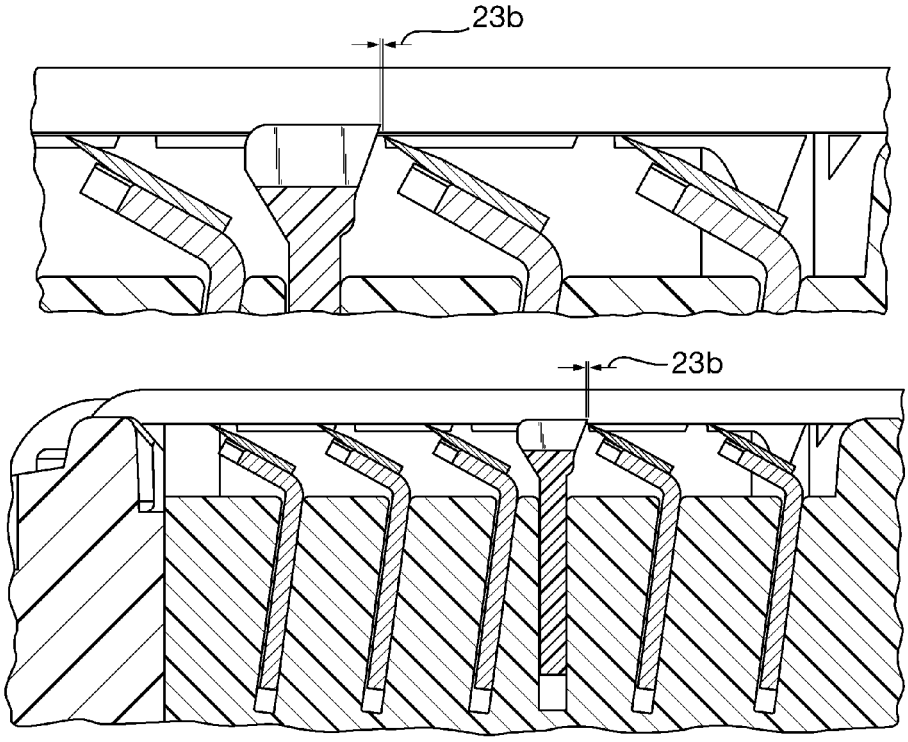
FIGS. 4A and 4B are cross-sectional views of alternate embodiments of razor cartridges of the present invention.
Figure 4B:
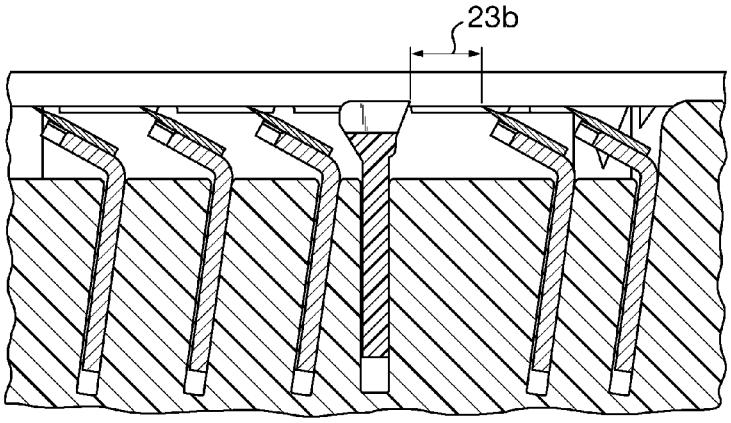

In FIG. 2, "rinse-through gaps" (e.g. gaps for cut hair and debris to flow into that generally represent the shortest distance between the blades or the blades and fixed points such as the guard or the cap) are provided both before and after the skin contact element 14 as shown at first rinse-through gap 23*a* and second rinse-through gap 23*b*, respectively. The first rinse-through gap 23*a* may range from about 0.05 mm to about 0.5 mm and desirably about 0.1 mm to about 0.2 mm and the second rinse-through gap 23*b* may range from about 0 mm (FIG. 4A) to about 0.65 mm (FIG. 4B) and desirably about 0.2 mm to about 0.5 mm. Generally, standard razor blades cartridges have rinse-through gaps (e.g., effectively the shortest distance between blades) that are about 0.5 mm wide and have a primary blade span of about 0.65 mm (e.g., the distance from the guard 16 to the first blade 12*a*). With a skin contact element 14 disposed in the cartridge 10, the rinse-through gap spacing may generally decrease particularly if the blades are spaced closer together. The open slots in the skin contact element will provide improved rinsing capability and thus allow for reduced spacing between the blades.

Having a first rinse-through gap 23*a* disposed before the skin contact element 14 allows any excess hair that is cut by the second blade 12*b* or other debris to flow into this gap 23*a*, avoiding clogging the blades further back in the cartridge. Furthermore, second rinse-through gap 23*b*, disposed after the skin contact element 14 may provide an area for cut hairs to flow into (e.g., hairs that are cut by the third blade 12*d* directly behind the skin contact element 14).

First rinse-through gap 23*a* and second rinse-through gap 23*b* may be the same width or one gap may be of a smaller width than the other. For instance, it may be desirable to design first rinse-through gap 23*a* with a smaller width than second rinse-through gap 23*b* since blade 12*e* may have more cut hairs and excess debris flowing in between skin contact element 14 and blade 12*e*.

As shown in FIG. 2, the blade tip span 22 between cutting edge 13*b* of blade 12*b* and cutting edge 13*d* of blade 12*d* with element 14 disposed there between ranges from about 1.00 mm to about 2.50 mm and desirably about 2.10 mm. Thus, the span 22 may be almost double the length of a conventional blade tip span or an inter-blade span between adjacent blades having no skin contact element 14 disposed there between, as shown for instance, at span 24 in FIG. 2 between cutting edge 13*a* of blade 12*a* and cutting edge 13*b* of blade 13*b* which may be about 1.05 mm, or even more desirably about 0.95 mm.

Figure 5A:
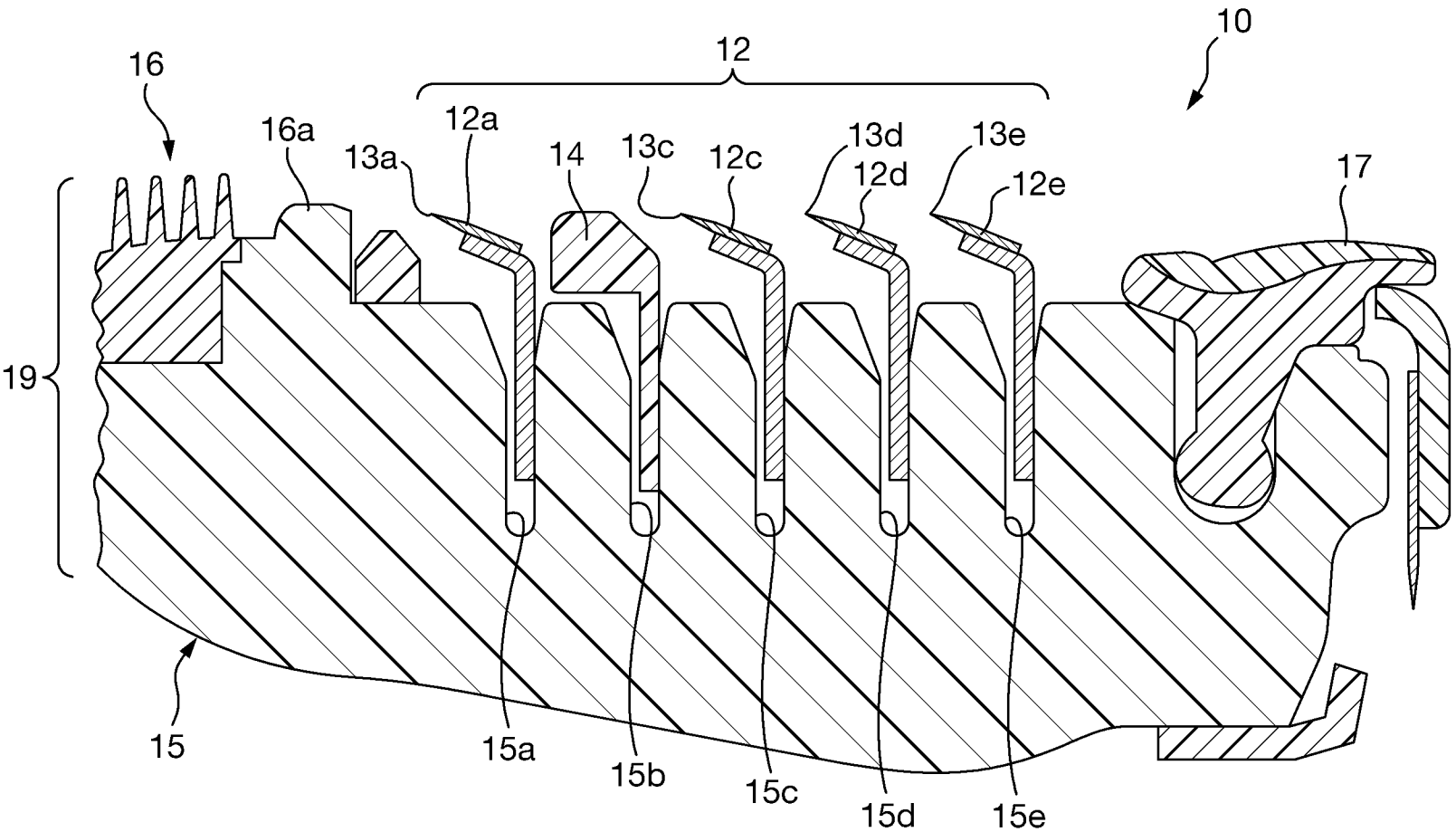
FIGS. 5A through 5C are cross-sectional views of alternate embodiments of razor cartridges of the present invention.
Figure 5B:
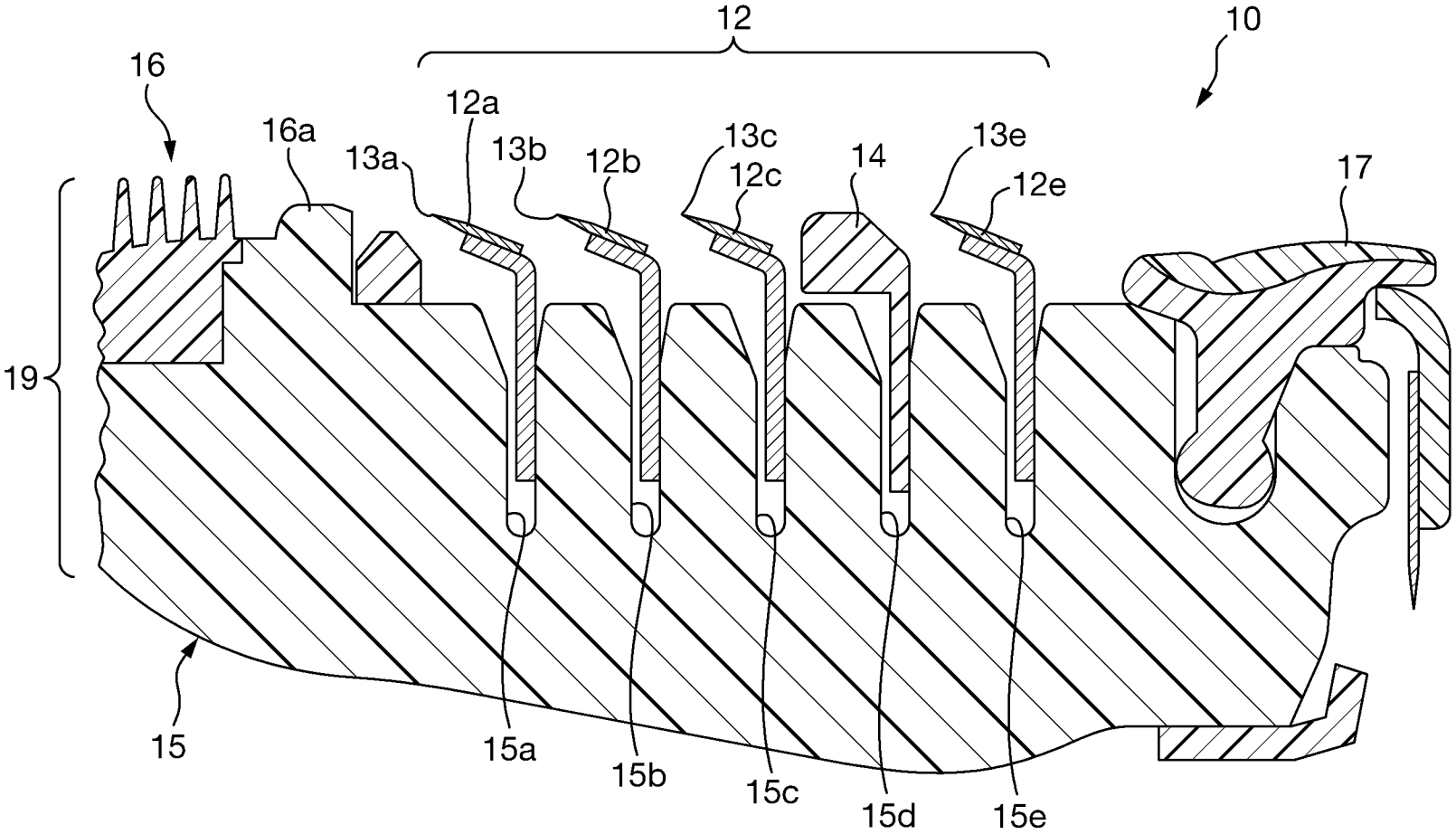

Though shown disposed in the $3^{rd}$ or middle blade position of a five-bladed razor cartridge 10 in FIG. 1, the skin contact element 14 of the present invention may be disposed at, near or in any position or blade slot of a razor cartridge having any number of blades, provided that it is disposed between two blades. In a five-bladed razor cartridge, the skin contact element 14 may be disposed at, near, or in any of the $2^{nd}$, $3^{rd}$, or $4^{th}$ positions or blade slots of a razor cartridge typically utilized for five blades with the remaining blade slots having blades. Specifically referring to FIGS. 5A and 5B, other possible locations of a skin contact element 14 of the present invention are shown. For instance, the skin contact element 14 may be disposed in the $2^{nd}$ position at slot 15*b* as shown in FIG. 5A, and hence, in between two blades 12*a* and 12*c*; or in the $4^{th}$ position or slot 15*d* in FIG. 5B in between two blades 12*c* and 12*e*. The skin contact element 14 is shown disposed in the $3^{rd}$ position or slot 15*c* as described above with regard to FIG. 1; thus, between two blades, blades 12*b* and 12*d*.

Figure 5C:
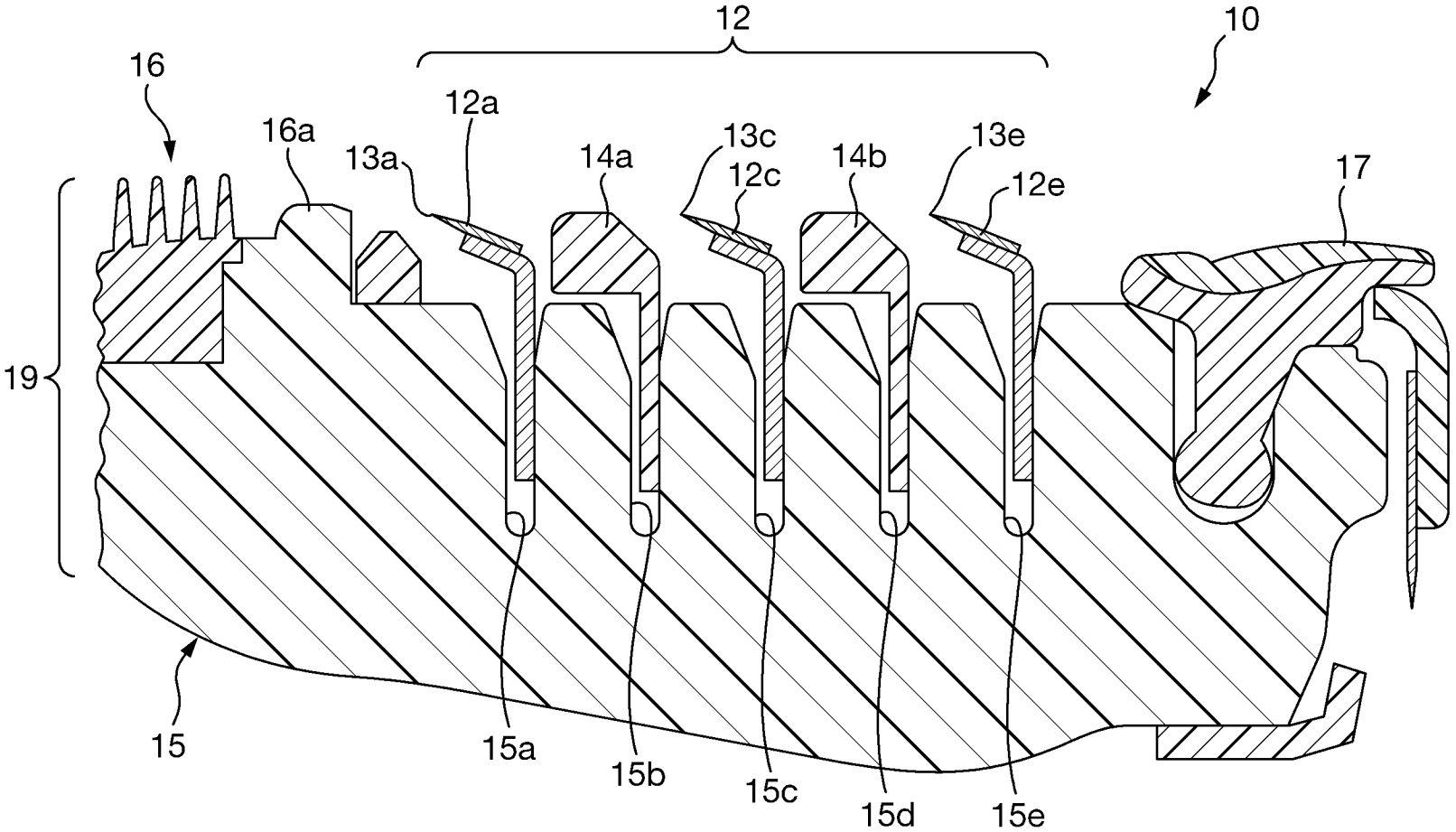

The present invention further contemplates having more than one skin contact element 14 disposed in the blade array 12 of cartridge 10, as shown in the illustrative embodiments of FIG. 5C. For instance, in FIG. 5C, two skin contact elements 14*a* and 14*b* are disposed in the 2nd and $4^{th}$ positions (or blades slots 15*b* and 15*d*), respectively.

Generally however, with little to no change to the structure of cartridge 10 or its housing 19, where a housing generally includes a frame 15 and a guard 16, any variation of types and numbers of blades and one or more skin contact elements 14 may be provided in the present invention.

It is known that blade exposure may impact the skin loading on the blade, which in turn may affect shaving attributes such as comfort, safety and efficiency. Thus, referring now to FIG. 6, blade exposures of a traditional razor design 40 with multiple blades or a blade array 12 (e.g., without a skin contact element disposed in the blade array 12) are shown as being defined by the positioning of the individual blades (12*a*-12*e*) relative to the guard 16 and/or guard bar 16*a* and the cap 17 where the guard/guard bar and the cap provide first and second control points for the skin, respectively. Thus, exposure may be determined by drawing a fairly straight line 44*a* (an imaginary or virtual skin line) through the cap 17 and guard 16 and noting where the blade edges 13*a*-13*e* (or blade tips) fall relative to that straight line 44*a*.

Figure 6:
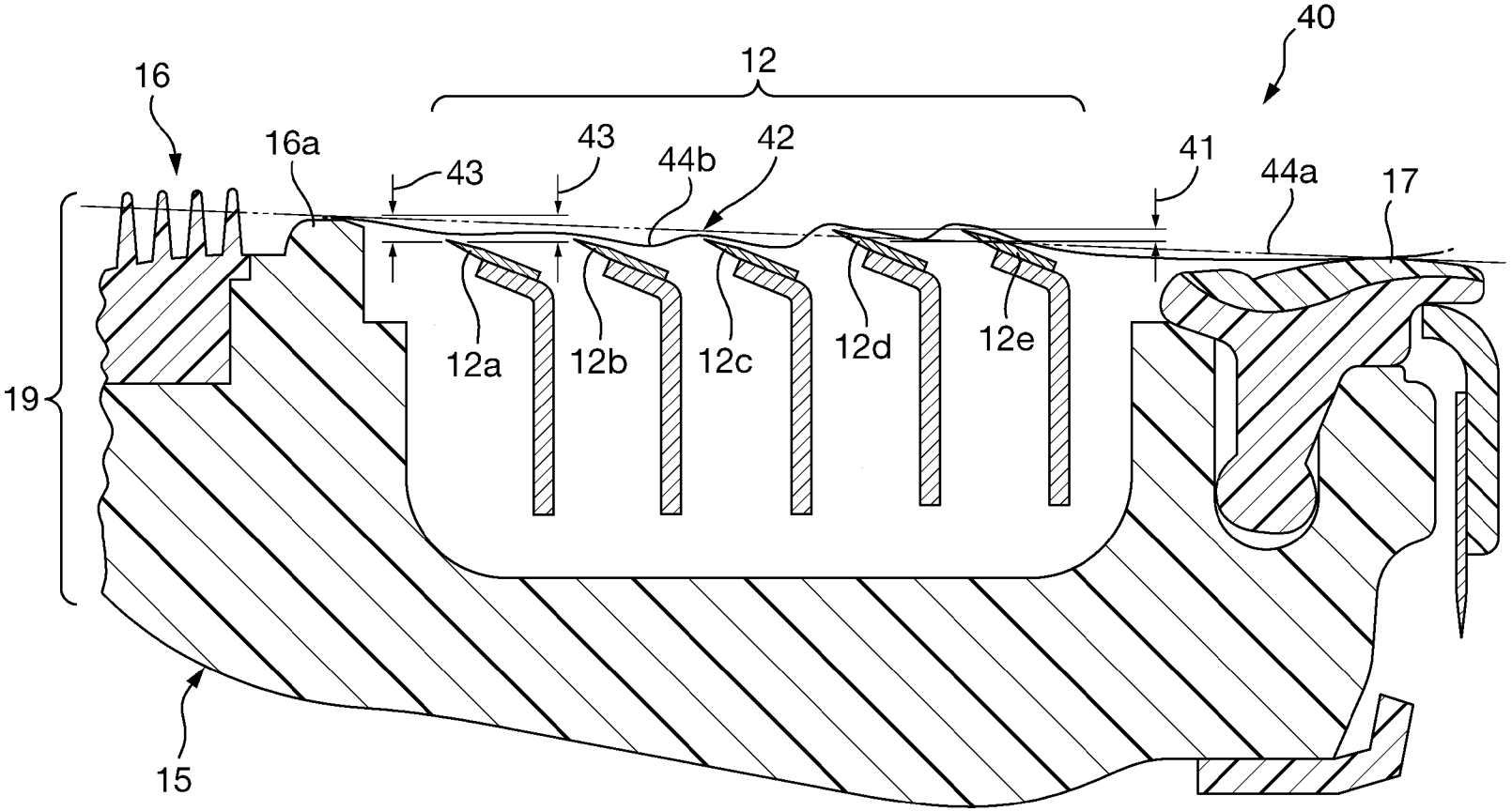
FIG. 6 is a cross-sectional view of a conventional razor cartridge and the respective blade exposures.

The blades as arranged together in FIG. 6 provide a progressive geometry as described in U.S. Pat. Nos. 6,212,777 and 6,216,349. Consequently, as it is known in the art, based on the assumption that the skin may generally lie flat or in a fairly straight line between the guard bar 16*a* and cap 17 as depicted by virtual skin line 44*a*, this blade positioning may be used to produce a negative blade exposure 43 at blade 12*a* since blade 12*a* is below the level of the guard bar 16*a*, a neutral blade exposure 42 at blade 12*c* since blade 12*c* is at the same level or plane as the guard bar 16*a* or the cap 17, and a positive blade exposure 41 as shown at blade 12*e* since the tip of the blade 12*e* is above the cap 17. Additionally, blade 12*b* may have a negative exposure and blade 12*d* a positive exposure as depicted vis-à-vis the virtual skin line 44*a*.

The negative exposure 43 for blades 12*a* and 12*b* may desirably be in the range from about −0.18 mm to about −0.01 mm and more desirably about −0.07 mm while the positive exposure 41 for blades 12*d* and 12*e* may desirably be in the range from about 0.18 mm to about 0.48 mm, and more desirably about 0.33 mm.

In general, having some positive and some negative exposures in the blade array may be preferred since blades with some negative exposure may be better at protecting the skin while optimally cutting the hair and blades with some positive exposure may be better at releasing trapped hairs. However, it may also be preferred to have neutral or zero exposures throughout the array such that the skin just skims the surface, substantially minimizing the contact with the blades and therefore, improving shaving attributes such as comfort and safety.

As can be seen, a positively exposed blade, such as blade 12*e* from FIG. 6, may generally push the skin line 44*b* up and away from the virtual line 44*a* producing more blade tip loading while a negatively exposed blade, such as blade 12*a* from FIG. 6, may generally rely on the skin line 44*b* to bulge into the cartridge and to come into contact with blade 12*a* itself, rather than blade 12*a* pushing up into the skin or skin line 44*a*. This illustration demonstrates that it may likely be easier to control the skin flow near the guard/guard bar and near the cap which represent fixed (or control) points over which the skin flows. Guided by these concepts in general, it may be seen that this geometric control may thus become less precise the further away a blade is from either the cap 17 or guard 16/guard bar 16*a*. Thus, in many instances, midway through a cartridge 10 or near the center of a blade array 12 may be an area where there may be a loss of defined skin control.

While conventional razors aptly control skin and hair flow across an entire razor cartridge or blade array, the addition of one or more skin contact elements within the blade array 12 (desirably centrally located) advantageously inserts at least one more control point for skin, thereby allowing greater control over the geometry for individual or small groups of blades, fine tuning skin bulged, exposure and also blade tip loading for much improved comfort and cutting of hair (e.g., in closeness and number) and hence, shaving performance, as will be described below.

It should be noted that in the above-described embodiments of FIG. 5C, where two skin contact elements 14*a* and 14*b* are inserted into the blade array, two supplementary control points are provided via those skin contact elements in addition to the guard 16 and cap 17 control points. Further, the present invention may theoretically contemplate an embodiment of a razor cartridge having minimized or possibly non-existent guard 16 or cap 17 structures (not shown).

Figure 6A:
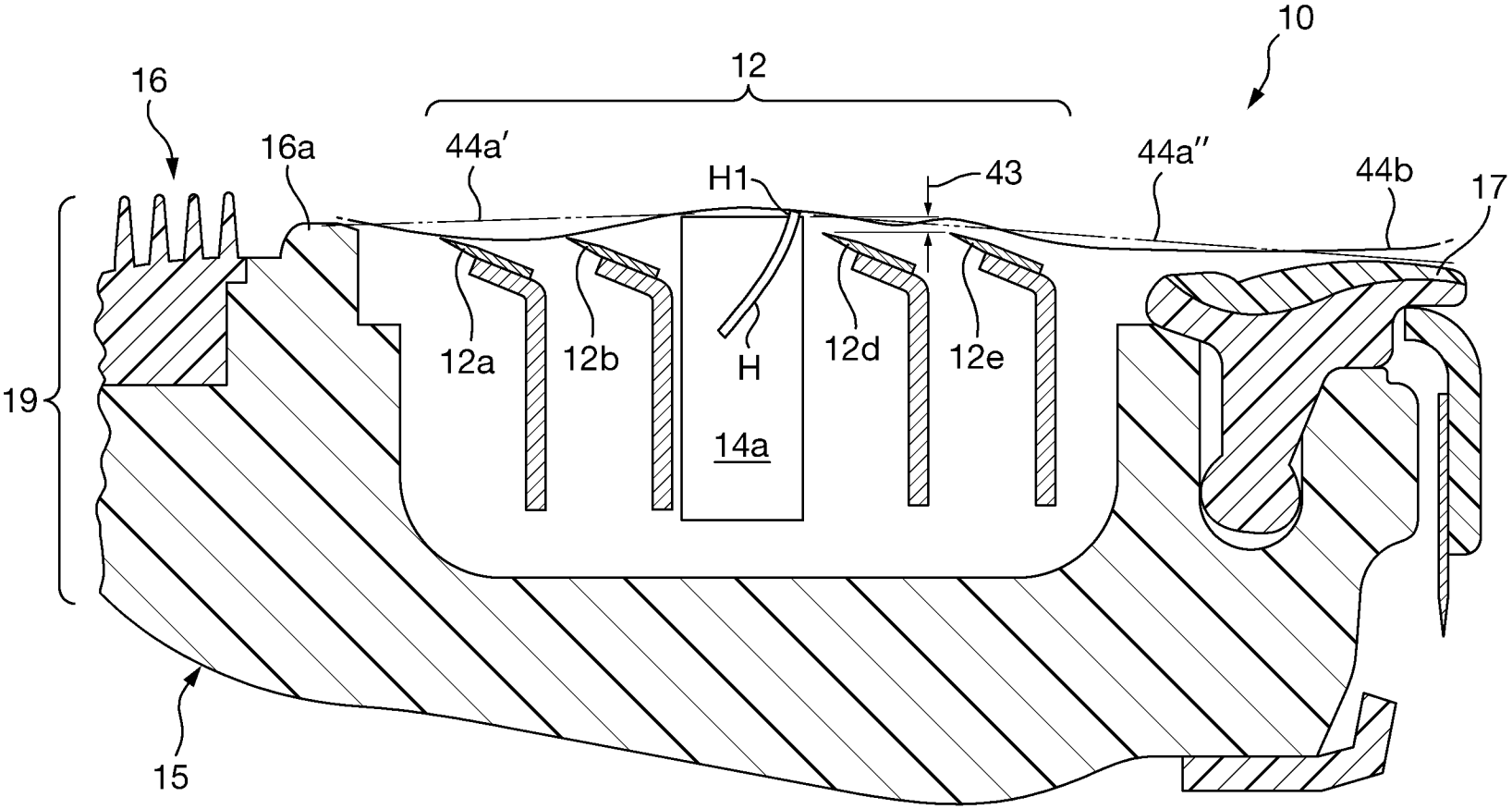
FIG. 6A is a cross-sectional view of a razor cartridge showing a skin contact element therein and the respective blade exposures of the present invention.

Referring now to FIG. 6A, the addition of at least one skin contact element 14 generally in the middle of the blade array 12 of FIG. 6, effectively provides a central or third control point (in addition to the first and second guard and cap control points, respectively) thereby imparting a desired or greater manipulation of the skin loading of a single or group of blades. With a third control point, there may effectively be two skin lines. For instance in FIG. 6A, referring to virtual skin lines, there may be a virtual skin flow line 44*a*' from guard bar 16*a* to skin contact element 14 and a virtual skin flow line 44*a*" from skin contact element 14 to cap 17.

The skin contact element 14 may lie on the same plane as the blades 12*a*, 12*b*, 12*d*, and 12*e* of the blade array 12 or on a different plane or any combination thereof. The skin contact element 14 may also lie on the same plane as blades 12*b* and 12*d*, but on a different plane from the plane of blades 12*a* or 12*e*. The latter arrangement would provide a neutral exposure for blades 12*b* and 12*d* relative to the skin contact element 14 and may lower the blade tip loading on the skin near the area of the skin contact element as those blades may just skim the skin.

It may be also preferred to adjust the blades' exposures such that blade 12*d* is set at a negative exposure relative to the skin contact element 14. For example, as can be seen in FIG. 6A, the exposures of the blades 12*a*, 12*b*, 12*d*, and 12*e* of the blade array 12 are arranged similarly to that of FIG. 6, relative to each other, but the presence of the skin contact element 14 in between blades 12*b* and 12*d* and its being disposed slightly higher than one or both of blades 12*b* or 12*d*, preferably 0.05 mm higher, provides not only a fixed control point but a negative exposure for those lower blades. Thus, just after the blade 12*b*, the skin contact element will force the actual skin line 44*b* up to its upper surface 14*a* as shown in FIG. 6A and desirably may prevent hair H from being pushed down. For illustrative purposes, only one hair H is shown in FIG. 6A. The negative exposure of the blade 12*d* relative to skin contact element 14 which may desirably be up to about −0.2 mm may, as the shave stroke passes the skin contact element 14 and contacts blade 12*d* behind it, desirably minimize blade 12*d*' s contact with the skin 44*b*, or effectively mask the skin, allowing contact of blade 12*d* to be substantially with just hair H. This in turn, desirably allows the hair H to also be cut at a point H1 closer to the skin such that more of the length of each hair will be cut, improving the extent to which missed hairs are cut and also increasing the number of missed hairs that are cut and therefore, upgrading the perception of the shave outcome by the user (e.g., the skin will feel smoother right after shaving).

With the presence of a skin contact element in the blade array, all the blades may desirably be substantially prevented from coming into contact with the skin (e.g., improved comfort, glide and safety), but the boosting of the height of the hair provides expanded blade contact with the hair combined with the blades' minimal to no contact with the skin (e.g., in particular at the blade 12*d* behind the skin contact element 14 as described above) improves the cutting of the hair.

However, were the skin contact element 14 of FIG. 6A disposed such that there was a neutral or zero blade exposure relative to each of the blades in the blade array 12 (e.g., so that the blades and skin contact element just skim the skin), attributes such as shaving comfort, glide and safety are also improved during the shave.

Furthermore, having one or more skin contact elements disposed in the blade array may advantageously allow even sharper blades (e.g., with low cutting forces) or other blade arrangements to be utilized, without which, in a conventional razor may be too sharp (e.g., dangerous risk of cutting) or uncomfortable for users. For example, a very sharp type blade may desirably be disposed in the blade position directly behind such a skin contact element (e.g., blade 12*d*).

The inter blade span of the present invention may range from about 0.5 mm to about 2 mm. Preferably the interblade span is from 0.95 mm to 1.05 mm.

Figure 6B:
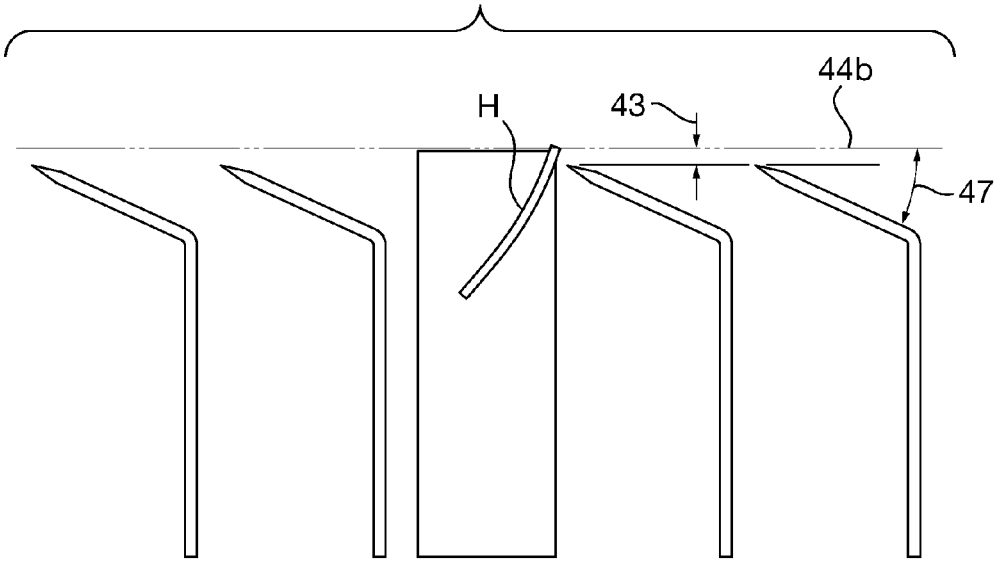
FIG. 6B is a side view of a razor cartridge of the present invention showing a skin contact element therein and the respective blade tangent angles.
Figure 6C:
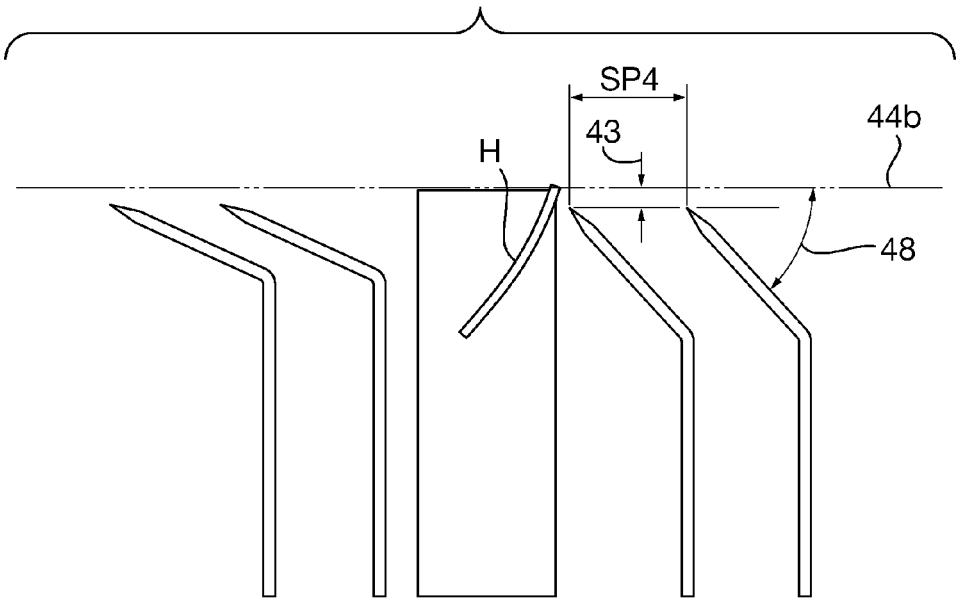
FIG. 6C is a side view of a razor cartridge showing a skin contact element therein and the respective blade tangent angles in accordance with an alternate embodiment of the present invention.

With the knowledge that the blade may substantially not contact the skin, or just skim the skin as shown in FIG. 6A having neutral or negative exposure for instance, the blades following the skin contact element of the present invention may also be modified to include even sharper blades and/or blades with a higher "blade tangent angle" (BTA) than conventional blade arrays, the latter shown in FIG. 6C.

Referring particularly to the BTA, it is generally known to signify the angle between the blade and the skin line. Increasing this angle may also allow the second stage to catch hairs that a more conventional first stage or cartridge unit 10*a* may have missed. However, adjustments to the BTA require some forethought in design as it is generally known that a higher BTA may improve closeness (e.g., more hairs cut), but typically at the expense of comfort (e.g., blades may drag on skin and damage it) whereas in contrast, a lower BTA may improve comfort, but typically at the expense of closeness.

With regard to BTAs, FIGS. 6B and 6C illustrate two arrangements of the present invention. In FIG. 6B, the blade tangent angle 47 may range from about 10 to 24 degrees from the skin line 44*b* and may desirably be about 22.5 degrees. FIG. 6B may be representative of a BTA that may be found in the arrangement of FIG. 6A.

In FIG. 6C, the BTA 48 may range from about 25 to 40 degrees from the skin line 44*b* and may desirably be about 28 degrees. In addition, FIG. 6C is shown with narrow spans, similar to the spans of FIG. 6B. The narrow span and the increase in BTA shown in FIG. 6C compared to FIG. 6B, along with the negative exposure 43 of at least blade 12*d*, may desirably provide an improved blade tip loading on the skin and improve the numbers of hairs that are cut without skin damage.

Such a cartridge may advantageously provide a application of the skin contact element of the present invention. For instance, a cartridge may be choicefully designed to have different functionality before and after a centrally located skin contact element and hence, target different types of hair and/or different hair areas (e.g., neck, chin, face, body). For instance, the cutting of difficult, low lying hair may be improved with the arrangement of FIG. 6C.

Thus, in arranging a cartridge with the skin contact element(s) of the present invention providing a generally central control point, a balancing of the several inter-related variables such as blade types, angles, spans, exposures, and number of blades relative to control points such as the skin contact element, guard and cap, may generally be important for providing optimal designs that will not damage the skin while also effectively cutting the hair.

The presence of the skin contact element or control point of the present invention makes available a wider range of possibilities for the fine-tuning of these inter-related variables than permitted in conventional razor cartridges and thereby may provide more advantages.

As mentioned above, desirably blade sharpness and angles may be increased, spans may be decreased and exposures may be neutral or negative to provide undamaged skin and to cut more hair (both in extent and number). Furthermore, the skin contact element shall desirably allow skin and hair to pass without generating high friction thus maintaining the skin contact element as a substantially low friction element within the blade array.

Figure 7:
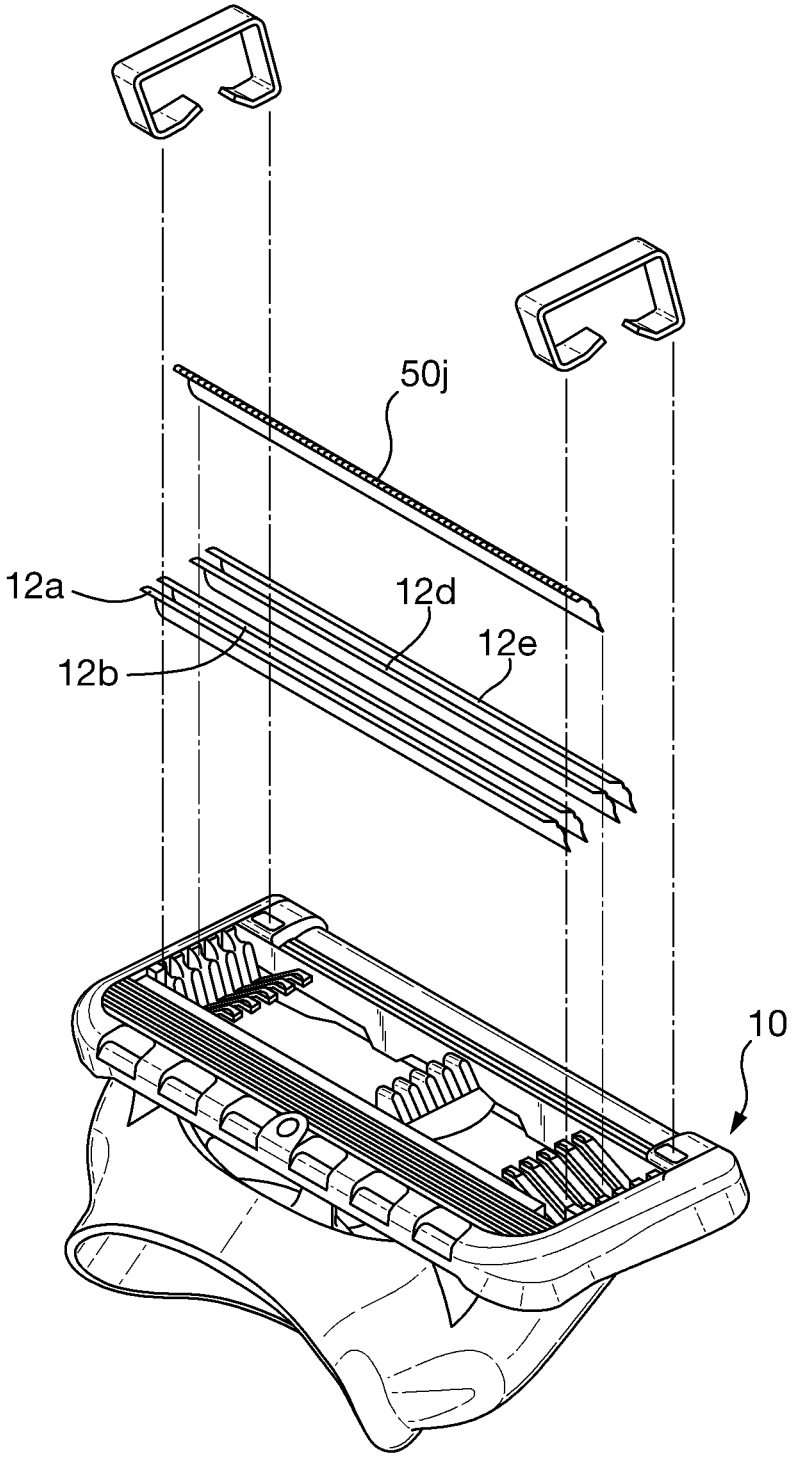
FIGS. 7 through 10 are perspective views of possible embodiments of skin contact elements in accordance with the present invention.

FIG. 7 depicts the skin contact element 50*j* desirably formed as a modified or extended blade support made of any material but advantageously comprised of the same type of metal conventionally used for a blade support. Arrows pointing downward in FIG. 7 indicate the top-down loading of the skin contact element 50*j* and blades 12*a*, 12*b*, 12*d*, and 12*e* into the cartridge 10.

While the skin contact elements described thus far are generally loaded into or installed into blade positions or slots from the top of the blade array or cartridge (e.g., similar to razor blade installation), the present invention is not limited to placement of skin contact elements in conventional blade positions or blade slots.

Other methods of manufacturing a skin contact element for placement within a blade array will be disclosed below.

Figure 8:
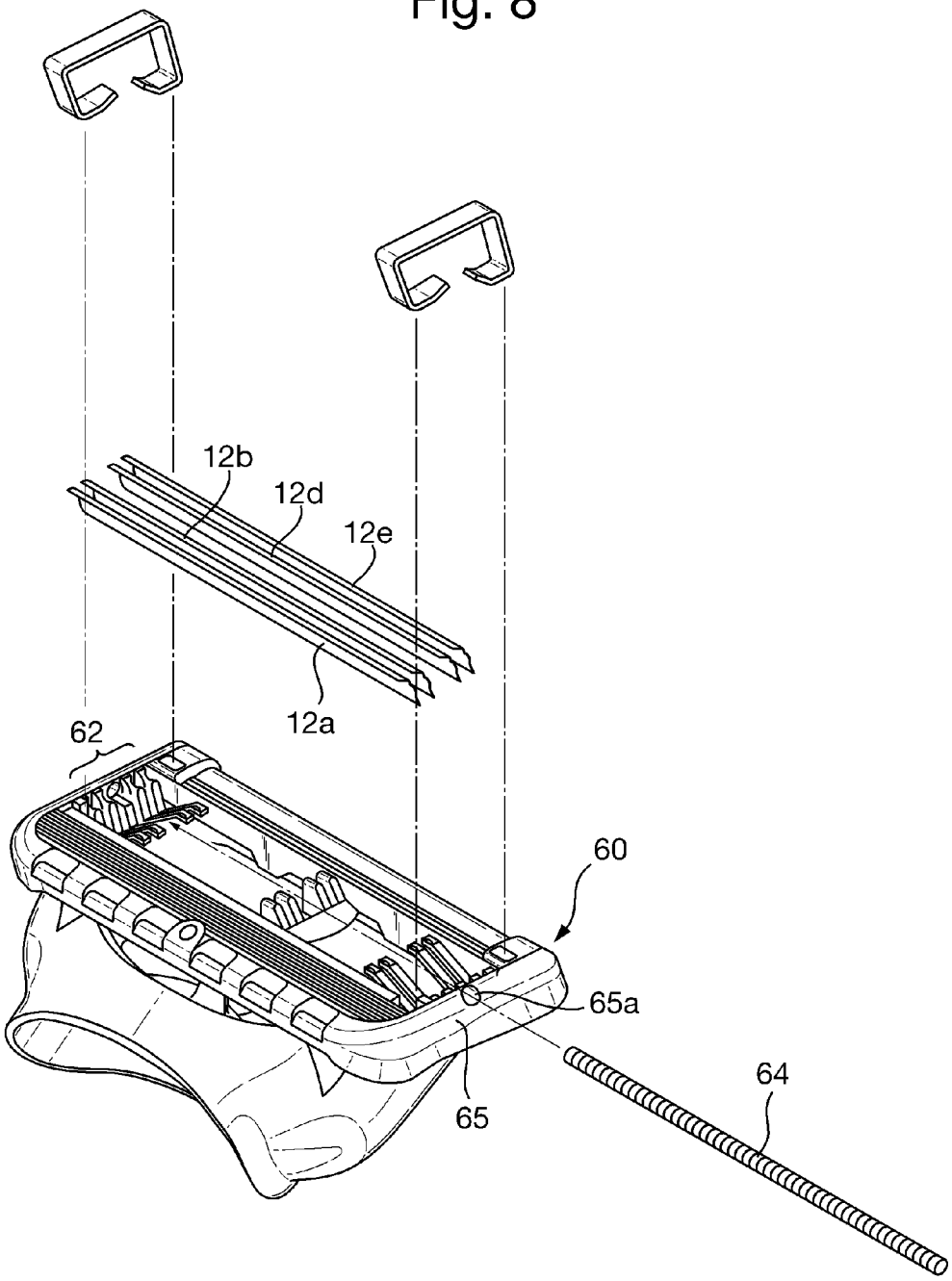

The skin contact element of the present invention may, for instance, be loaded into the blade array 62 via at least one hole, aperture or slot 65*a* disposed in at least one of the sides of the cartridge frame 65 as shown in FIG. 8. Hole 65*a* may desirably be sized and structured to be able to effortlessly insert and generally hold the skin contact element 64 in place within the blade array 62 and therefore, within the razor cartridge 60.

Thus far, the skin contact element of the present invention has been described as being an independent, standalone, or separable element or elements, much like the razor blades themselves. Given that the instant element is a skin contact element with no cutting edges, alternate methods for providing such a skin contact elements in a razor cartridge may also be within the scope of the present invention. Such alternative embodiments of the present invention are described below.

Figure 9:
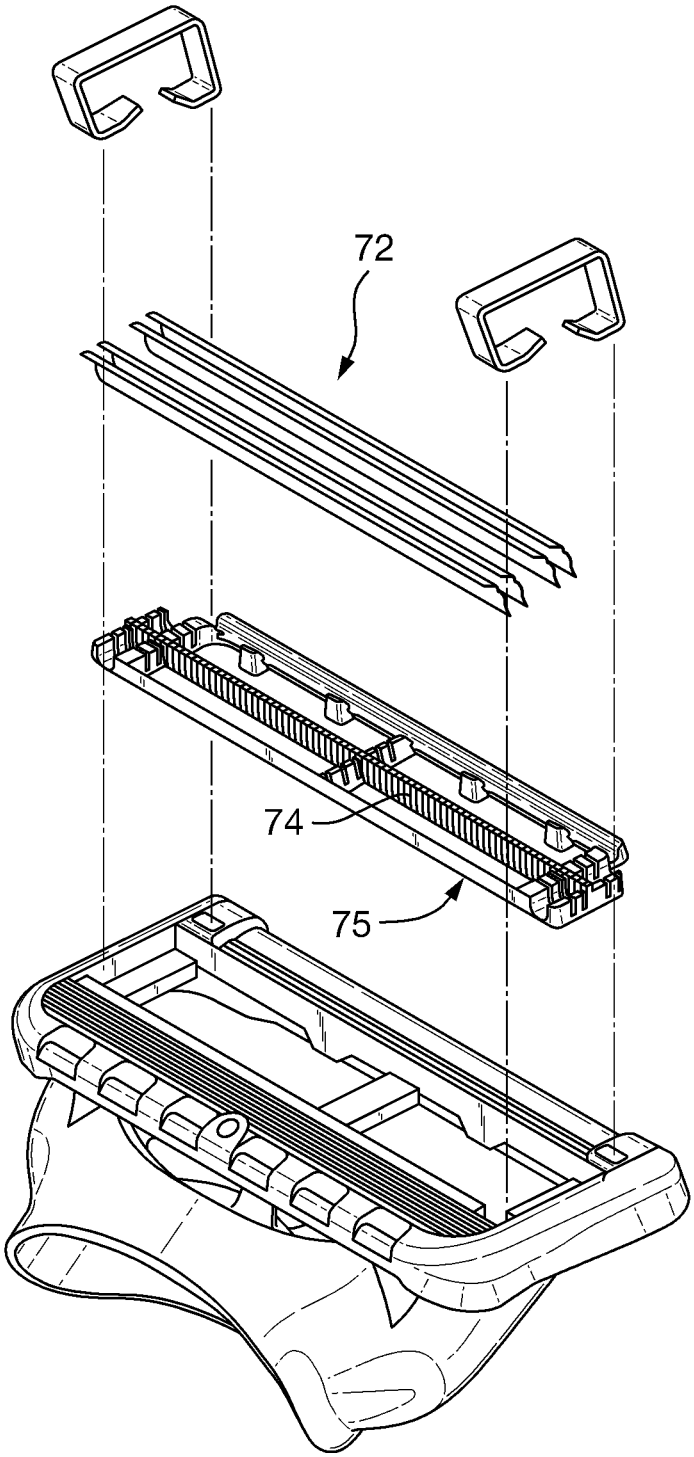

Referring now to FIG. 9, one such exemplary alternate embodiment of the present invention is shown to include at least one skin contact element 74 formed as a portion of the frame 75 as shown in the close-up view of the frame 75 in FIG. 9. For instance, the frame 75 may be injection-molded to include at least one skin contact element 74 desirably positioned lengthwise in any location in the cartridge, as generally described above with regard to FIGS. 1-3. The skin contact element may also be coupled to the frame via a snap fit or other known connection. Skin contact element 74 may be coupled to the frame 75 using other mechanical, thermal, chemical methods known to those of skill in the art. It should be noted that the skin contact element, formed together with the frame, can also be attached to or integrated with a razor blade or blades. The skin contact element, though part of the cartridge frame, may be of elastomeric or other material.

Figure 10:
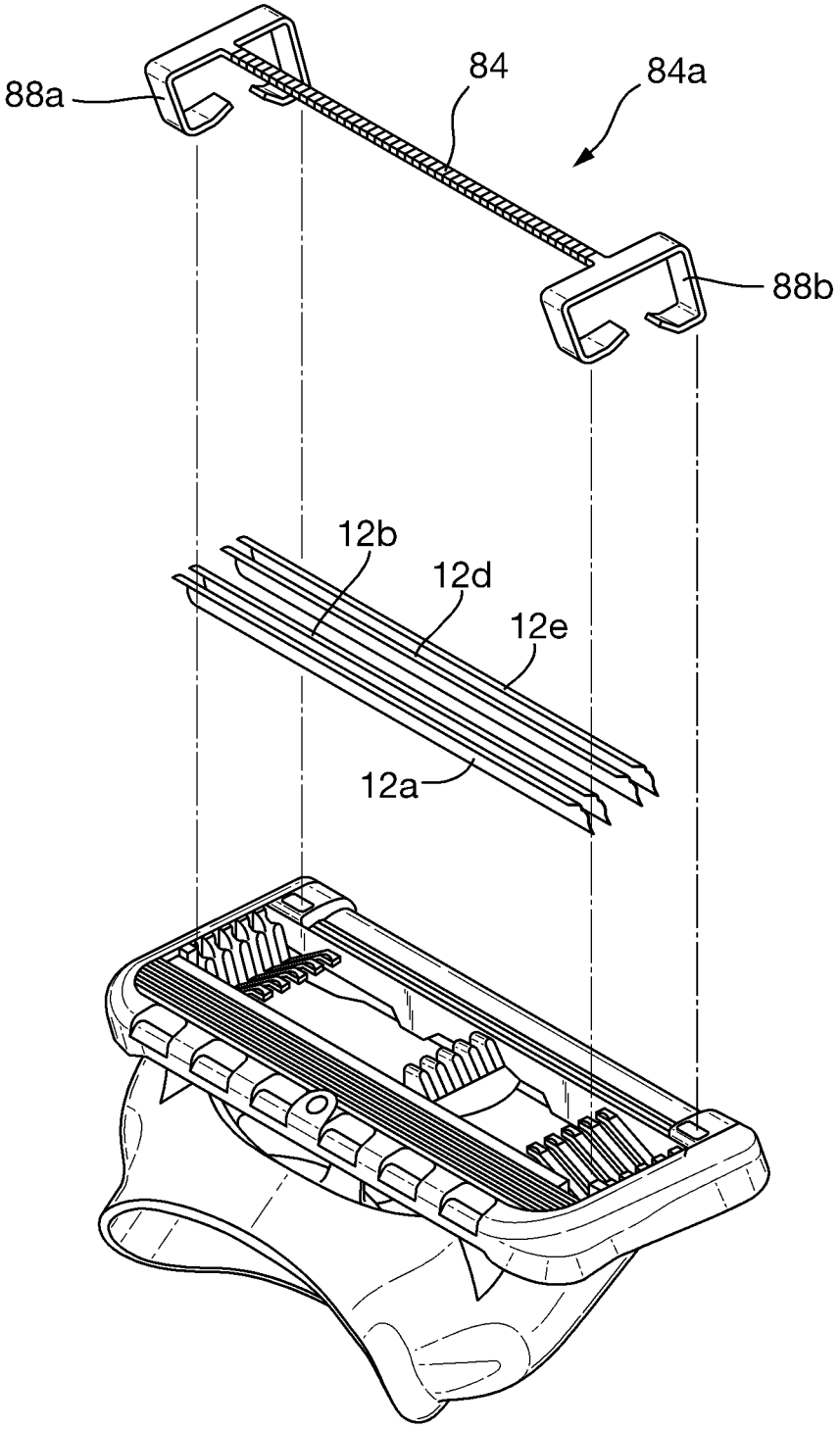

Additionally, in FIG. 10, another exemplary alternate embodiment depicts a skin contact element 84 formed as a portion of both of the clips 88*a* and 88*b* as a unitary structure 84*a* and therefore necessarily installed into the frame (or cartridge) when the clips are installed. Though not shown, more than one skin contact element may be formed as a portion of the clips or the skin contact element may be formed as a portion of only one or the other clip 88*a* or 88*b*, respectively, in accordance with the present invention. Such a structure 84*a* may be made by one of skill in the art using the same methods as conventional clips and may be machined, molded, or formed in any feasible manner.

Though the skin contact element 74 may be formed as a portion of the frame 75 and skin contact element 84 may be formed as a portion of the clips 88*a*, 88*b*, both being formed as part of another razor component, they are generally not attached to or integrated with any of the blades, but this is contemplated within the scope of the present invention. The shaving advantages attributed to having at least one skin contact element within the blade array remain unchanged.

Additionally, it should be noted that the skin contact element of the present invention may be utilized in any type of razor cartridge and thus naturally in both male and female type razors.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A razor cartridge comprising:

a) a housing (19);

b) a guard (16) located at the front of the housing;

c) a cap (17) located at the rear of the housing;

d) a plurality of blades (12) disposed in the housing between the guard and the cap, each of said plurality of blades having a cutting edge, each cutting edge facing in the same direction;

e) a skin contact element (14, 50) extending across the housing between two of said plurality of blades, and a rinse-through gap (23) immediately before and after the skin contact element wherein said skin contact element is not attached to any one of said plurality of blades disposed in the housing; and f) a plurality of projections (51) extending from a base (52) of said skin contact element, each having a skin contacting surface (54), the projections being spaced along the length of the skin contact element, wherein there is a pitch (53) of up to about 2 mm between adjacent projections and the skin contacting surface has a width (w) extending for up to about 35% of the pitch.

2. The razor cartridge of claim 1 wherein the skin contact element comprises between about 15 and 150 projections.

3. The razor cartridge of claim 1 wherein the skin contacting surface is about 0.10 mm to 0.70 mm in width.

4. The razor cartridge of claim 1 wherein the width of the skin contacting surface extends for up to about 25% of the pitch.

5. The razor cartridge of claim 1 comprising slots (55) between adjacent projections, where the slots have a width of between 0.19 mm to 1.3 mm.

6. The razor cartridge of claim 1 wherein each projection has a depth of between about 0.3 mm to 2.5 mm.

7. The razor cartridge of claim 1 wherein the projections comprise a curved section (59) of up to about 0.3 mm in length and wherein the projections comprise a substantially flat portion on a top face (58) of up to 0.6 mm in length.

8. The razor cartridge of claim 1 wherein the distance between two adjacent blade edges is less than 1.0 mm.

9. The razor cartridge of claim 1 wherein the projections have a height of from about 0.25 mm to 1.00 mm.

10. The razor cartridge of claim 1 wherein the blade tangent angle (48) of the blade following the skin contact element ranges from about 25 to 40 degrees.

11. The razor cartridge of claim 1, wherein said skin contact element is disposed in a blade position.

* * * * *